US008864469B1

(12) United States Patent
Liang

(10) Patent No.: US 8,864,469 B1
(45) Date of Patent: Oct. 21, 2014

(54) TURBINE ROTOR BLADE WITH SUPER COOLING

(71) Applicant: George Liang, Palm City, FL (US)

(72) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 14/163,535

(22) Filed: Jan. 24, 2014

Related U.S. Application Data

(63) Continuation-in-part of application No. 14/159,022, filed on Jan. 20, 2014.

(51) Int. Cl.
*F01D 5/18* (2006.01)

(52) U.S. Cl.
CPC ..... *F01D 5/186* (2013.01)
USPC ..... 416/97 R

(58) Field of Classification Search
CPC ..... F01D 5/18; F01D 5/08; F01D 5/185; F01D 5/186; F01D 5/187
USPC ..... 416/96 R, 97 R, 97 A, 95, 90 R; 415/115, 415/116
See application file for complete search history.

(56) References Cited

U.S. PATENT DOCUMENTS

| | | | | |
|---|---|---|---|---|
| 6,994,521 | B2 * | 2/2006 | Liang | 416/97 R |
| 2006/0002795 | A1 * | 1/2006 | Liang | 416/97 R |
| 2010/0040478 | A1 * | 2/2010 | Abdel-Messeh et al. | 416/97 R |

* cited by examiner

*Primary Examiner* — Ninh H Nguyen
*Assistant Examiner* — Maxime Adjagbe
(74) *Attorney, Agent, or Firm* — John Ryznic

(57) ABSTRACT

An air cooled turbine rotor blade with a leading edge region cooling circuit having pressure and suction side feed channels separated by a rib, where the feed channels are connected to metering and diffusion cooling channels formed in the pressure and suction side walls and the middle rib that discharge into three rows of exit slots on the leading edge of the blade. The trailing edge region cooling circuit includes rows of serpentine flow circuits each having an impingement channel along a suction side and a return channel in a middle that opens into metering and diffusion channels on the pressure side that discharges into exit slots on the pressure side of the trailing edge region. The middle of the blade is cooled with a multiple pass aft flowing serpentine flow circuit with metering and diffusion film cooling slots.

16 Claims, 10 Drawing Sheets

Line A-A

Line B-B

Line C-C

TURBINE ROTOR BLADE WITH SUPER COOLING

CROSS-REFERENCE TO RELATED APPLICATIONS

This application is a CONTINUATION-IN-PART of U.S. patent application Ser. No. 14/159,022 filed on Jan. 20, 2014 and entitled TURBINE BLADE WITH TRAILING EDGE REGION COOLING.

GOVERNMENT LICENSE RIGHTS

None.

BACKGROUND OF THE INVENTION

1. Field of the Invention

The present invention relates generally to a gas turbine engine, and more specifically to a turbine rotor blade with total cooling of the entire airfoil.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

In the prior art, an airfoil leading edge is cooled with backside impingement cooling in combination with a showerhead arrangement of film cooling holes along with pressure and suction side film cooling (see FIG. 4). All leading edge region film cooling rows are supplied with cooling air from a common impingement cavity and discharge at various gas side pressures. As a result of this design, cooling flow distribution and pressure ratio across all of the leading edge region film cooling holes are both predetermined by the impingement cavity pressure. Also, the standard film cooling holes pass straight through the airfoil wall at a constant diameter and exit at an angle to the surface of the airfoil wall. Some of the coolant is subsequently ejected directly into the mainstream gas flow causing turbulence, coolant dilution, and a loss of downstream film cooling effectiveness. Further, the film cooling hole breakout on the airfoil leading edge surface many not achieve an optimum film coverage in a blade cooling application. The sidewall for the impingement cavity is cooled with a low heat transfer coefficient recirculation vortex created by the impingement jet. The cooling air supply cavity requires a reduction in the cross sectional flow area in the direction of the cooling air flow or through the flow Mach number in order to maintain adequate heat transfer capability as the cooling air is bled off from the cavity.

BRIEF SUMMARY OF THE INVENTION

A turbine rotor blade with a super cooling circuit for the entire airfoil that includes a leading edge region with a pressure side cooling supply channel to deliver cooling air to a row of pressure side wall cooling channels and a row of middle section cooling channels that open into two rows of exit slots on the pressure side and the stagnation line in the leading edge region of the airfoil. A suction side cooling air channels with exit slots delivers cooling air to a row of suction side wall cooling channels and a row of multiple metering and diffusion film cooling slots on the suction side wall downstream from the leading edge region.

The trailing edge region is cooled with a series of cooling channels that each includes an impingement channel along the suction side wall that discharges into an impingement chamber on the inside corner of the trailing edge, followed by a return channel that flows forward and discharges into a open chamber, and then a multiple metering and impingement channel along the pressure side wall that opens into exit slots on the pressure side wall. The impingement channels and the return channels include chordwise ribs that form separate channels along the path.

The middle airfoil section of the airfoil is cooled with a five-pass aft flowing serpentine flow cooling circuit with rows of multiple metering and impingement film cooling channels having exit slots that discharge film cooling air from selected legs or channels of the serpentine flow circuit.

The multiple metering and diffusion film cooling slots provide additional heat transfer from the hot external wall surface to an inner channel through the metal material that forms the metering and diffusion sections within the channels.

DETAILED DESCRIPTION OF THE INVENTION

The present invention is an air cooled turbine rotor blade for use in a gas turbine engine, such as a large frame industrial gas turbine engine, where the blade cooling circuit and the blade is formed by a metal printing process with the cooling circuit have sizes and shapes that cannot be formed using a ceramic core with the prior art investment or lost wax casting process. The turbine blade super cooling circuit of the present invention uses multiple metering and diffusion film cooling to achieve a high level of film coverage over the full airfoil surface along with a five-pass aft flowing serpentine flow cooling circuit in the middle of the airfoil with large length-to-diameter (l/d) film cooling slots to maximize an airfoil internal convection cooling capability. The blade includes multiple metering and diffusion film cooling channels each with separate exit slots.

Figure 1:
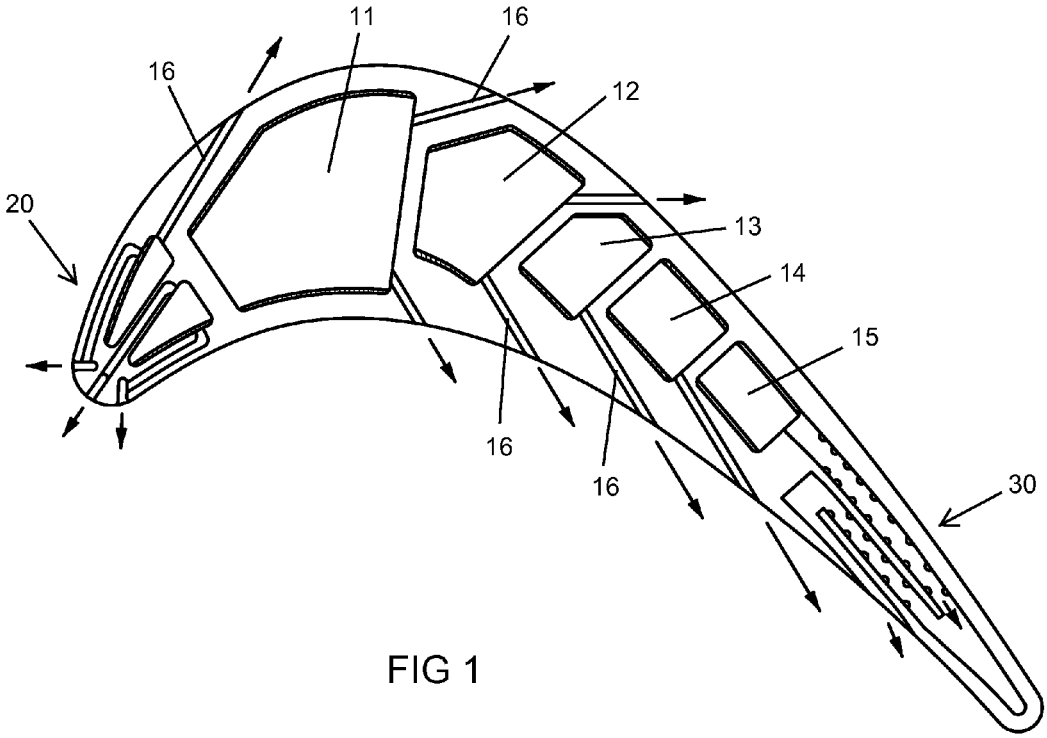
FIG. 1 shows a cross section top view of the turbine rotor blade with super cooling of the present invention.
Figure 15:
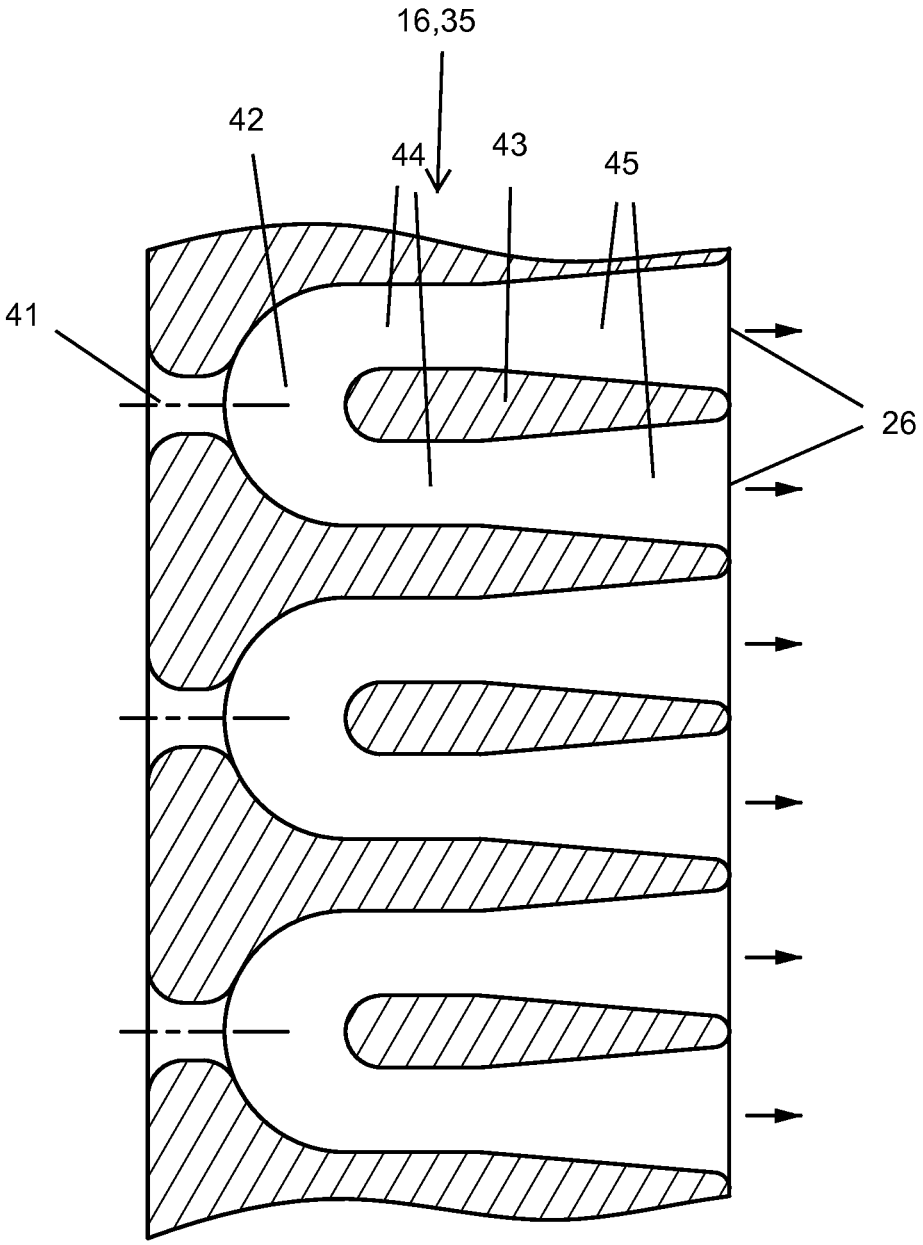
FIG. 15 shows a detailed cross sectional view of the multiple metering and diffusion film cooling channel with exit slots used in the trailing edge region and the walls of the airfoil of the present invention.

The turbine blade with super cooling of the present invention is shown in FIG. 1 with a leading edge region cooling circuit 20, a trailing edge region cooling circuit 30, and a five-pass aft flowing serpentine flow cooling circuit in the middle section between the two edge regions 20 and 30. The five-pass serpentine flow cooling circuit includes a first leg or channel 11 adjacent to the leading edge region cooling circuit 20, followed in the flow direction by a second leg 12 and a third leg 13 and a fourth leg 14 and a fifth or last leg 15 which is located adjacent to the trailing edge region cooling circuit 30. Each of the legs or channels 11-15 includes trip strips along the side walls to enhance the heat transfer from the hot wall surface to the flowing cooling air. The trip strips are micro sized trip strips that can only be formed using the metal printing process and not the investment casting process. The five legs or channels 11-15 can include rows of multiple metering and diffusion film cooling slots 16 that are long channels that also provide convection cooling to the airfoil walls as well as discharging film cooling air from exit slots for the airfoil external wall surface. The multiple metering and diffusion film cooling slots 16 are shown in FIG. 15 and described in more detail below.

Figure 2:
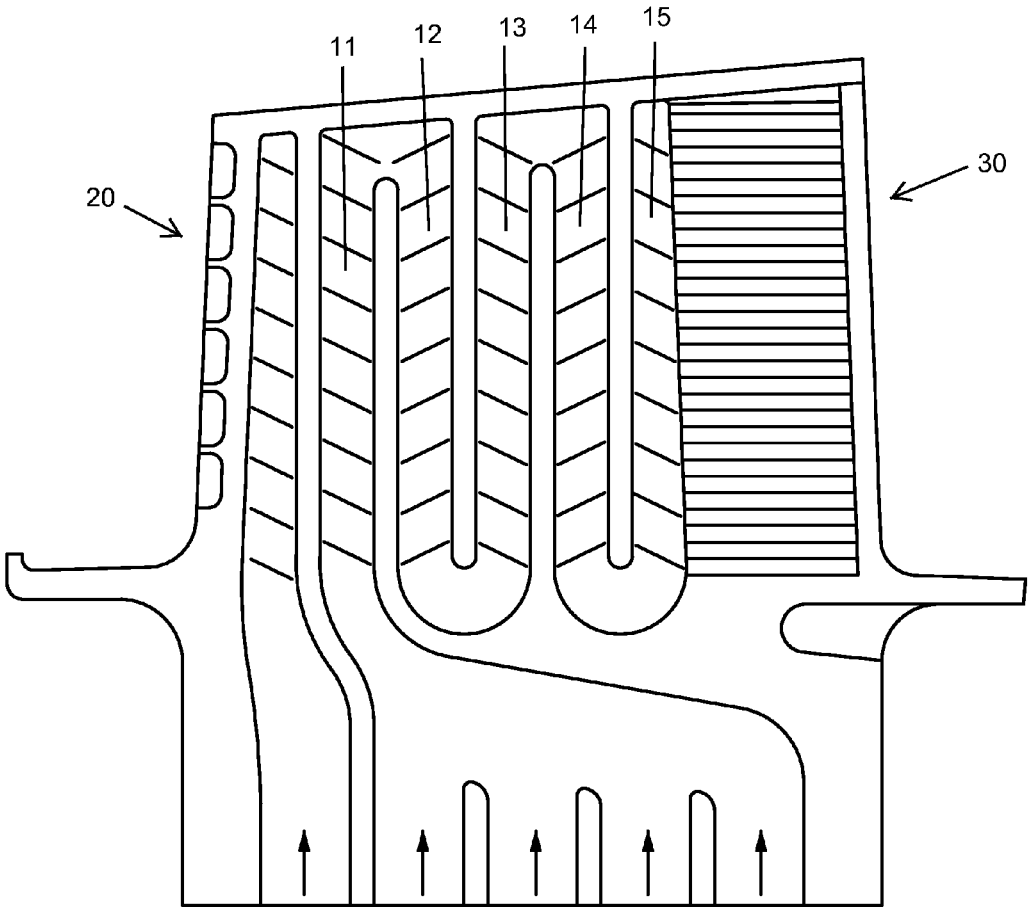
FIG. 2 shows a cross section side view of the turbine rotor blade with super cooling of the present invention.

FIG. 2 shows a side view of the blade with the super cooling circuit of the present invention. The five legs or channels 11-15 extend from a platform section to a blade tip section. The trailing edge region cooling circuit 30 is supplied with cooling air from the fifth or last leg 15 of the five-pass serpentine flow cooling circuit. The leading edge region cooling circuit 20 is supplied with cooling air from a separate cooling supply channels connected to an opening in the blade root.

Figure 3:
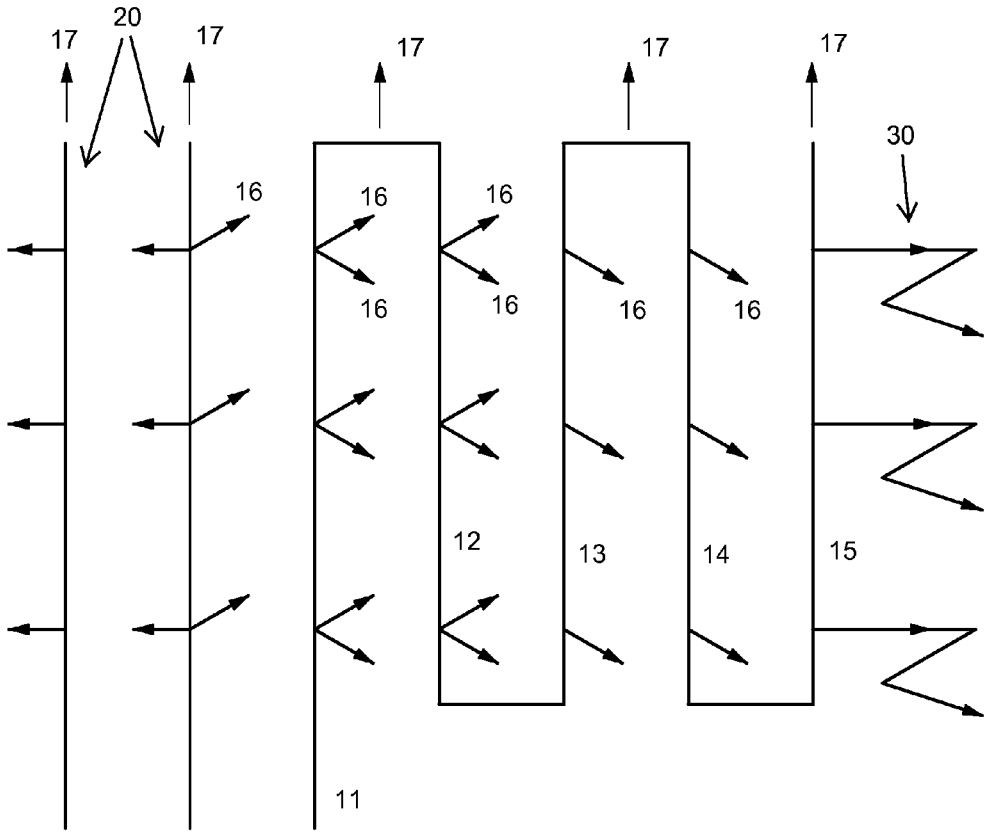
FIG. 3 shows a flow diagram of the turbine rotor blade with super cooling of the present invention.
Figure 4:
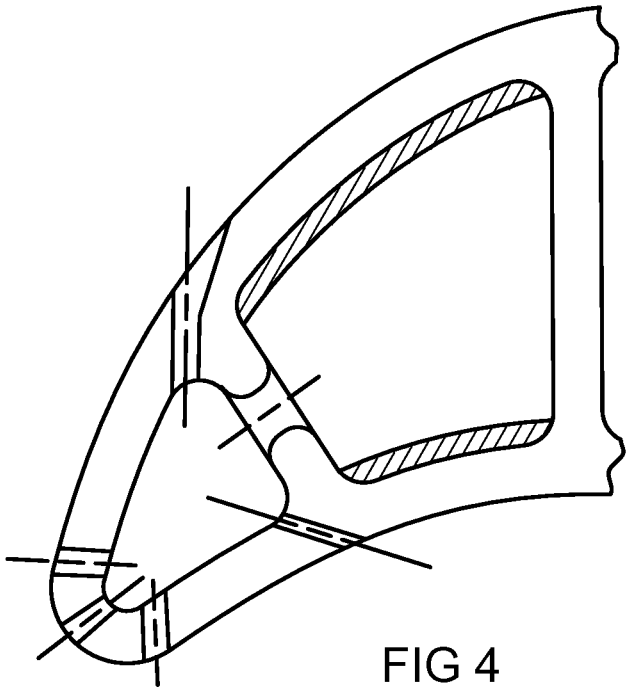
FIG 4 Prior Art
FIG. 4 shows a cross section view of a leading edge region cooling circuit of the prior art.

FIG. 3 shows a flow diagram for the blade with the super cooling circuit of the present invention. The radial cooling channels and the tip turns of the serpentine flow circuit include tip cooling holes 17 that discharge some of the cooling air through the blade tip in order to provide cooling for the blade tip section. Rows of film cooling holes 16 discharge film cooling air to required surfaces of the pressure side wall and the suction side wall from the channels.

Figure 5:
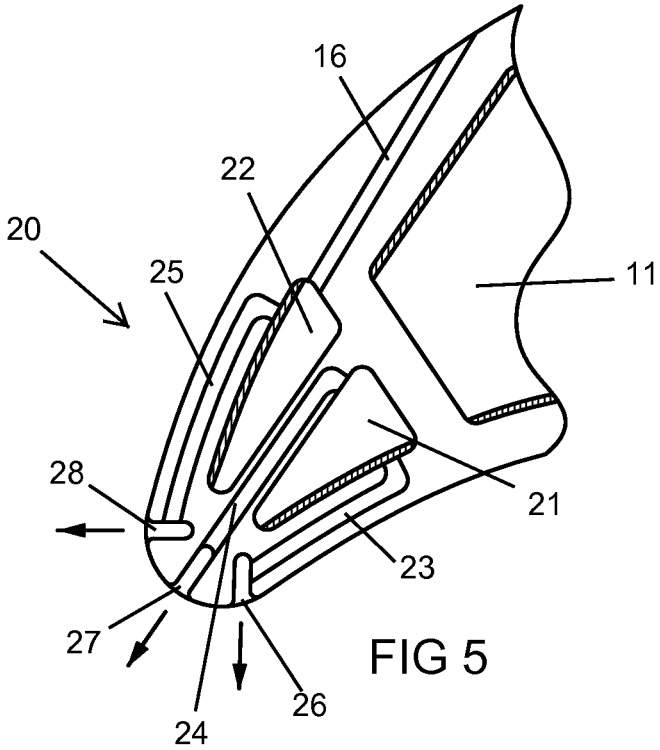
FIG. 5 shows a cross section detailed view of the leading edge region cooling circuit of the blade with super cooling of the present invention.

A detailed view of the leading edge region cooling circuit 20 of the blade with the super cooling circuit is shown in FIG. 5. The leading edge region cooling circuit includes a pressure side feed channel 21 and a suction side feed channel 22 separated by a rib and connected to an external source of cooling air through the blade root channel. The supply channels 21 and 22 both extend along the entire airfoil from root to the blade tip. Rows of multiple metering and diffusion film cooling channels are formed on the walls of the airfoil leading edge region between the two supply channels 21 and 22 that open into exit slots of the leading edge of the airfoil. Rows of pressure side multiple metering and diffusion film cooling channels 23 are formed in the pressure side wall and are connected to the P/S feed channel 21 and open into P/S exit slots 26. Rows of stagnation row multiple metering and diffusion film cooling channels 24 also connect to the P/S supply channel 21 and open into stagnation row slots 27. Rows of suction side multiple metering and diffusion film cooling channels 25 are formed in the suction side wall and are connected to the S/S feed channel 22 and open into S/S exit slots 28. A row of suction side gill holes 16 also is connected to the S/S feed channel 22 and open on the suction side wall downstream from the leading edge region of the airfoil.

Figure 6:
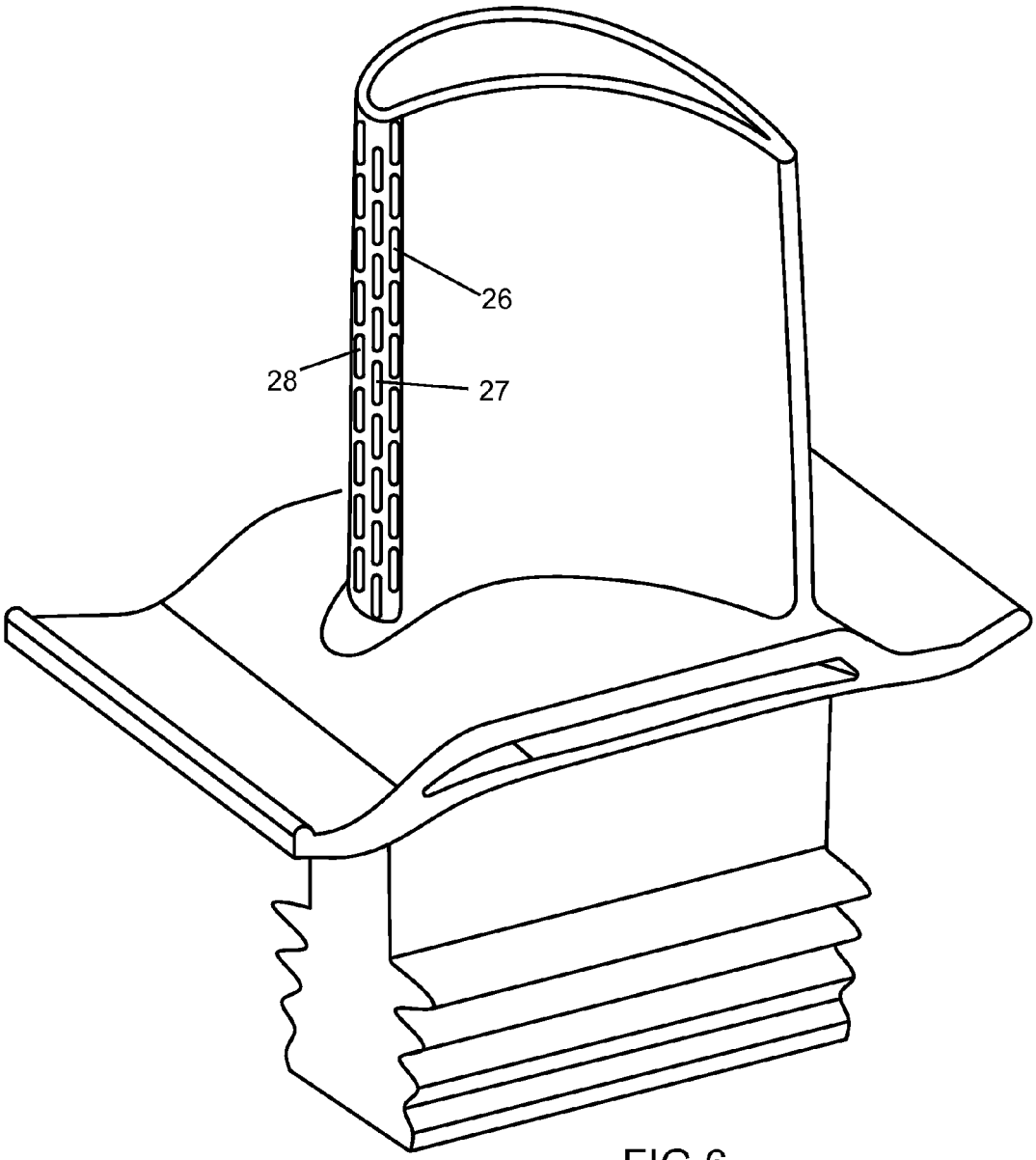
FIG. 6 shows a schematic view of a turbine rotor blade with three rows of leading edge cooling slots for the blade with super cooling of the present invention.
Figure 7:
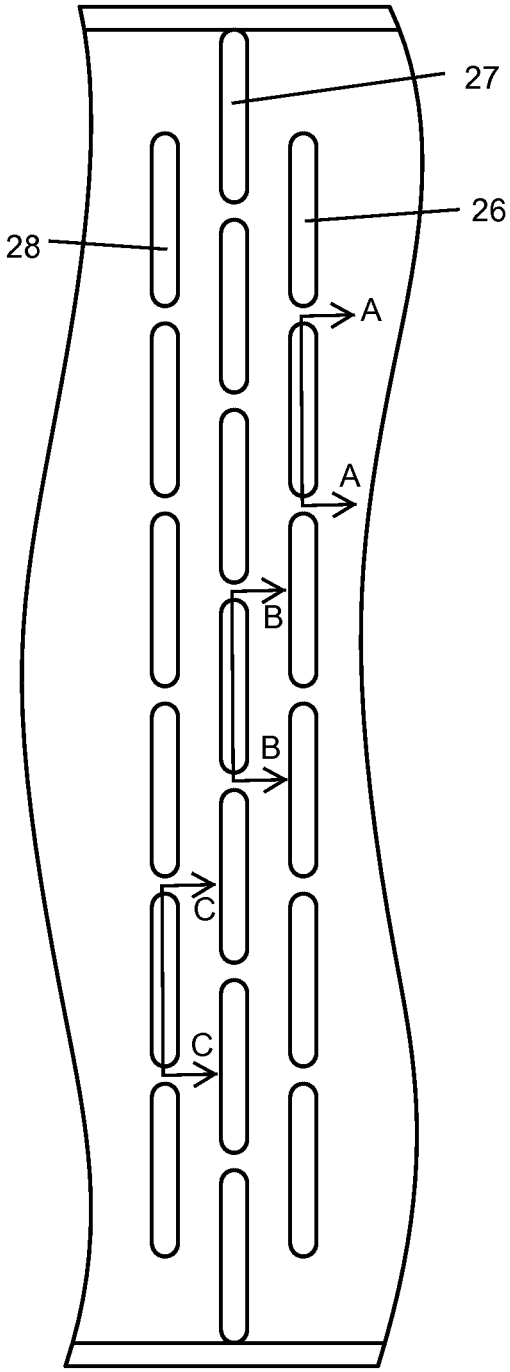
FIG. 7 shows a front view of a leading edge region of a turbine rotor blade with three rows of leading edge cooling slots for the blade with super cooling of the present invention.

As seen in FIG. 6, three rows of exit slots are formed on the leading edge region of the airfoil. One row of exit slots 26 are on the pressure side of the stagnation line, a second row 27 is along the stagnation line, and a third row 28 is on the suction side of the stagnation line of the airfoil. The rows of exit slots have a spanwise or radial direction length much greater than a width and extend along the entire airfoil surface from platform to blade tip. FIG. 7 shows a more detailed view from a front of the leading edge with the three rows of exit slots 26, 27 and 28. Each diffusion slot has a spanwise length of around 0.33 inches and a width of around 0.04 inches.

Figure 8:
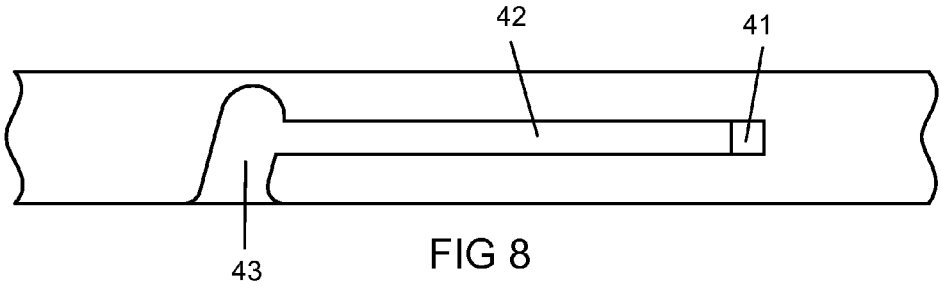
FIG. 8 shows a cross section view of a metering and diffusion micro sized cooling channel used in a leading edge region of the blade with super cooling of the present invention.

FIG. 8 shows a cross section view of one of the multiple metering and diffusion film cooling channels formed in the airfoil wall. The film cooling channel includes a cooling air inlet 41, a cooling air channel 42, and a diffusion slot 43 with rounded corners and a deep bottom. The cooling channel 42 directs cooling air to impingement on an opposite side of the diffusion slot 43 prior to discharging the film cooling air.

Figure 9:
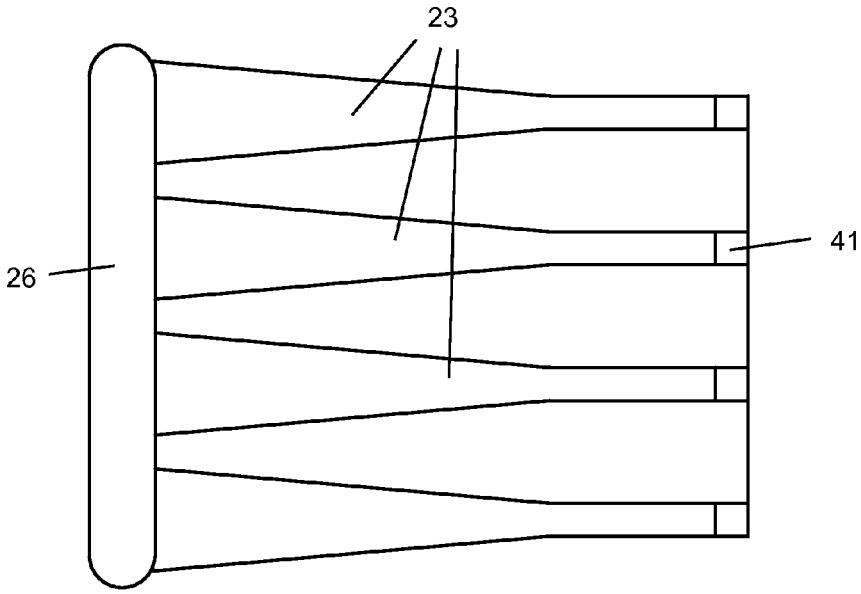
FIG. 9 shows a side view of a multiple metering and diffusion cooling module used on a pressure side in the leading edge region of the blade with super cooling of the present invention.

Each of the multiple metering and diffusion film cooling channels along the P/S wall and the S/S wall and the middle rib or stagnation row are formed as separate modules in which each module includes a number of multiple metering and diffusion channels 42 that open into a common exit slot 43. FIG. 9 shows one of the multiple metering and diffusion film cooling modules used along the pressure side wall in the leading edge region. In this embodiment of the module, four cooling air inlets 41 open into four channels 23 that all then open into one exit slot 26. Each cooling air channel 23 is angled at around 90 degrees from the long axis of the exit slot 26.

Figure 10:
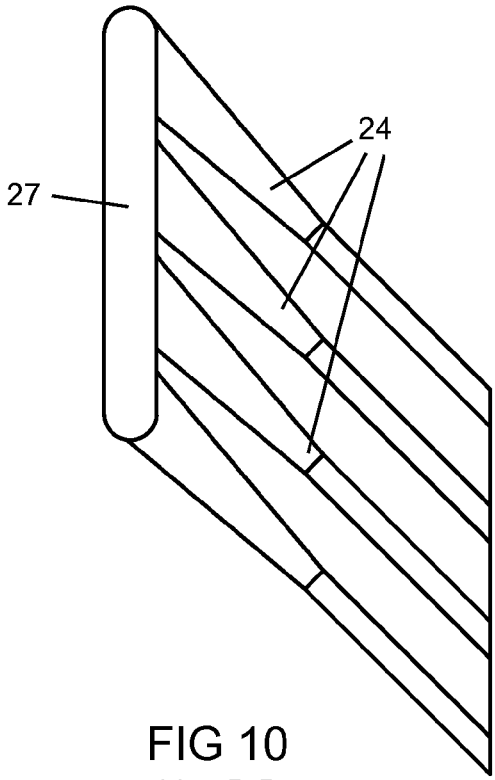
FIG. 10 shows a side view of a multiple metering and diffusion cooling module used on a stagnation line in the leading edge region of the blade with super cooling of the present invention.

FIG. 10 shows one of the multiple metering and diffusion film cooling modules used along the stagnation line or middle section in the leading edge region. In this embodiment of the module, four inlet holes open into four cooling air channels 24 that all open into one exit slot 27. The cooling channels are angled at around 45 degrees from the long axis of the exit slot 27 for the middle row of exit slots that open along the stagnation line of the airfoil.

Figure 11:
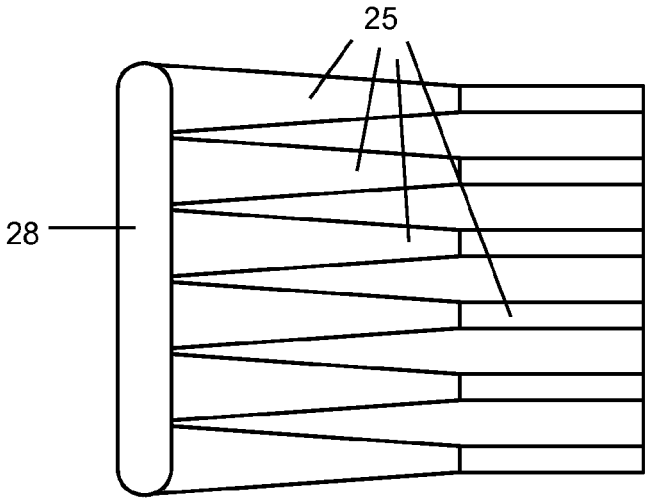
FIG. 11 shows a side view of a multiple metering and diffusion cooling module used on a suction side in the leading edge region of the blade with super cooling of the present invention.

FIG. 11 shows one of the multiple metering and diffusion film cooling modules used along the suction side wall in the leading edge region. In this embodiment of the module, four cooling air inlets 41 open into six channels 25 that all then open into one exit slot 28. Each cooling air channel 25 is angled at around 90 degrees from the long axis of the exit slot 28.

For the cooling channels in the modules of FIG. 9, the metering section has a diameter of around 0.02 inches in which adjacent metering sections are spaced around 0.0625 inches. The first diffusion sections immediately downstream from the metering sections has a diffusion wall angle of around 5 degrees from the axis of the metering section. In the slanted cooling channels in the FIG. 10 design, the channels are angled at around 445 degrees with spacing between adjacent metering channels of around 0.0425 inches. In FIG. 11, the metering sections are at around 0.02 inches in diameter with spacing of around 0.035 inches between adjacent metering sections.

The multiple metering and diffusion film cooling channels (23, 24, 25) are formed as separate modules by a metal printing process. One advantage of this is that each module can be custom tailored to the external pressure and temperature of that section of the airfoil for which that module is to provide cooling.

The use of two separated cooling air supply feed channel 21 and 22 for the airfoil leading edge region along with the near wall cooling channels (23, 24, 25) are used for the cooling of the leading edge region of the blade. The P/S feed channel 21 provides cooling air for use on the pressure side of the leading edge region while the second feed channel 22 provides cooling for the suction side of the leading edge region. The P/S feed channel 21 provides cooling air for the P/S showerhead row 26 and the stagnation row 27 of exit slots where the hot gas side discharge pressure is at about the same level. The S/S feed channel 22 provides the cooling air for the suction side row of exit slots 28 where the discharge pressure is much lower than on the pressure side. Micro sized cooling channels provide for a better control of coolant flow and enhanced leading edge film cooling. The double use of the cooling air in the small individual modules provides for a higher airfoil leading edge sidewall internal convection cooling capability over anything that is formed using a ceramic core with an investment casting process. The spanwise rib formed between the two feed channels 21 and 22 also functions to increase the airfoil leading edge internal convection cooling capability which results in a further reduction of the airfoil leading edge metal temperature.

The use of the multiple diffusion slot modules with discrete exit slots for the three rows of exit slots in the leading edge region instead of individual film holes will minimize the total hot gas side surface and thus result in a reduction of the airfoil total heat load into the airfoil leading edge region.

The multiple metering and diffusion film cooling channels is formed in small modules with the use of a metal printing process and without forming a ceramic core and an investment casting process. Smaller features and complex shapes can thus be formed that cannot be formed using a ceramic core because of limitations in forming of the ceramic core) and from the actual casting process in which a liquid metal is poured into mold (viscosity and flows). Each individual module is designed based on a gas side discharge pressure in both the chordwise and spanwise directions of the airfoil as well as designed at a desired coolant flow distribution for the showerhead and the pressure side and suction side rows of exit slots. The individual modules are arranged in a staggered array along the airfoil spanwise direction. With this design, a maximum usage of cooling air with an optimum film coverage for a given airfoil inlet gas temperature and pressure profile is achieved.

The micro sized metering and diffusion film cooling channels wrap around the leading edge cooling air feed channels which therefore provides side wall cooling for the cooling air supply channels. As the cooling air is bled off from the feed channel, the feed channel cross sectional flow area need not be reduced in order to maintain its internal Mach number flow. The micro sized multiple metering and diffusion film cooling channels geometry or diameter for each module can be changed within each film row in the spanwise direction to control the cooling flow area, the cooling channel convection surface area, and the pressure drop across the micro sized cooling channels.

Use of multiple metering and diffusion channels discharging into one common exit slot allows for the cooling air to diffuse uniformly into a discrete slot and will reduce the cooling air exit momentum. Coolant penetration into the hot gas path is therefore minimized, yielding a good buildup of the coolant sub-boundary layer next to the airfoil surface, and a better film coverage in the chordwise and spanwise directions for the airfoil leading edge region. All three of the multiple metering and diffusion film cooling channels (23, 24, 25) can be designed differently based on the discharge pressure and heat load requirements. Also, the micro sized cooling channels along the stagnation line will be at an angle (not 90 degrees or perpendicular) relative to the airfoil leading edge slot to prevent film blow off. the cooling air channels 24 that open into the row of exit slots 27 along the stagnation line (where the heat load is the highest on the airfoil) are positioned between the two feed channels 21 and 22 that function to insulate the cooling air channels 24 and minimize an increase of the cooling air temperature as opposed to the P/S wall and S/S wall cooling channels 23 and 25 that are exposed to the hot wall temperature.

In operation, the cooling air is supplied through the airfoil leading edge region feed channels 21 and 22, metered through the inlet holes 41 and diffused within the micro sized cooling channels. The cooling air flows in a chordwise direction toward the airfoil leading edge and then impinged onto the airfoil leading edge sidewalls and diffused into the discrete diffusion slots that open onto the airfoil surface. The cooling air then flows out of the slots as film cooling air onto the external airfoil surface.

Figure 12:
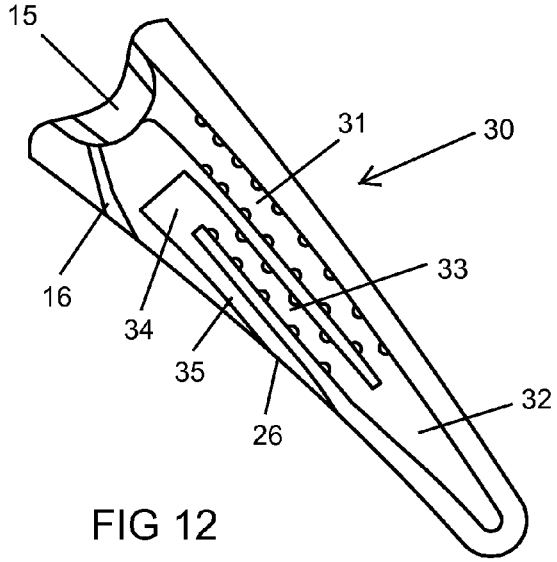
FIG. 12 shows a cross section detailed view of the trailing edge region cooling circuit of the blade with super cooling of the present invention.
Figure 13:
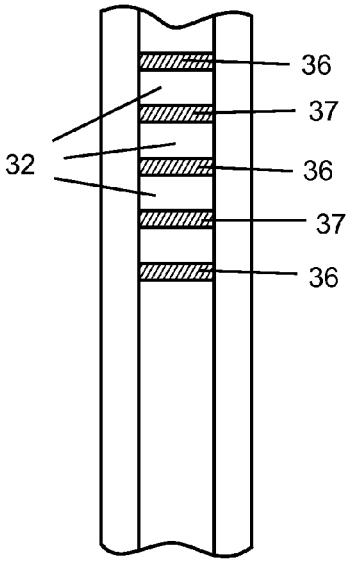
FIG. 13 shows a cross section view of the impingement chamber 32 in the corner of the trailing edge cooling circuit in FIG. 12.
Figure 14:
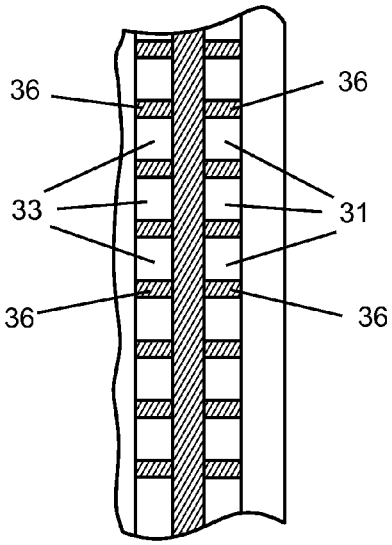
FIG. 14 shows a cross sectional view of the impingement channels and the return channels of the trailing edge cooling circuit in FIG. 12.

The trailing edge region is cooled by a circuit that is supplied with cooling air from a last leg or channel 15 of the five-pass serpentine flow cooling circuit formed between the two edges of the airfoil (see FIG. 12). The T/E region cooling circuit 30 includes separate rows of channels that extend in a spanwise direction along the entire airfoil from platform to blade tip. Impingement channels 31 are connected to the supply channel 15 and extend along the suction side wall to a row of impingement chamber 32 located at the trailing edge corner of the airfoil. A row of return channels 33 are connected to the row of impingement chambers 32 and open into an open cavity 34 that extends the entire spanwise length of the airfoil from the platform to the blade tip. The impingement channels 31 and impingement chambers 32 and return channels 33 and are separated into channels by ribs 36 as seen in FIG. 14. In the impingement chambers 32, adjacent ribs 36 that form a separated channel is also formed with extended fins 37 that provide for additional convection surface area within the channels 36. Micro sized trip strips are formed on both side wall of the impingement channels 31 and the return channels 33.

A row of multiple metering and diffusion film cooling slots (16,35) are connected to the open cavity 34 and include rows of first metering holes 41 that discharge cooling air onto a separation rib 43 and into a first diffusion chamber 42. The cooling air then flows around the separation rib 43 and into an upper metering and diffusion channel and a lower metering and diffusion channel. The upper and lower channels separated by the rib 43 include a second metering section 44 and a second diffusion section 45 that then opens into exit slots 26 that open onto the pressure side wall of the airfoil upstream from the trailing edge. Thus, the cooling air from the return channels 33 flows from the open cavity 34 and through the first metering holes 41 to impingement on the separation ribs 43, where the cooling air is then diffused in the first diffusion chamber 42. The cooling air then flows around the separation ribs 43 and into the upper channel or lower channel where the cooling air is metered a second time 44 and then diffused a second time 45 before discharging out through the upper or lower exit slots 26. The multiple metering and diffusion film cooling slots (16,35) are also used along the pressure and suction side walls for the discharge of film cooling air from the legs or channels (11-15) of the serpentine flow circuit.

One of the features of the T/E region cooling circuit 30 is the use of the metal material such as the separation ribs 43 that form the metering and diffusion passages which function to transfer heat from the hot pressure side wall and into the cooling air flowing through the return channels 33.

I claim the following:

1. An air cooled turbine rotor blade comprising:

a leading edge region;

a trailing edge region;

a middle region with a pressure side wall and a suction side wall;

the leading edge region having a pressure side feed channel and a suction side feed channel separated by a middle rib;

a first row of exit slots opening on a surface of the leading edge region of the blade;

a first row of cooling channels formed in a pressure side wall of the leading edge region and having inlets connected to the pressure side feed channel and outlets connected to a common exit slot in the first row of exit slots;

a second row of exit slots opening on a surface of the leading edge region of the blade;

a second row of cooling channels formed in the middle rib and having inlets connected to the pressure side feed channel and outlets connected to a common exit slot in the second row of exit slots;

a third row of exit slots opening on a surface of the leading edge region of the blade; and, a third row of cooling channels formed in a suction side wall of the leading edge region and having inlets connected to the suction side feed channel and outlets connected to a common exit slot in the third row of exit slots.

2. The air cooled turbine rotor blade of claim 1, and further comprising:

the second row of exit slots is located at a stagnation line of the blade;

the first row of exit slots is located on a pressure side of the stagnation line; and, the third row of exit slots is located on a suction side of the stagnation line.

3. The air cooled turbine rotor blade of claim 1, and further comprising:

a fourth row of exit slots opening on a surface of the suction side wall downstream from the leading edge region; and, a row of metering and impingement cooling channels connected to the suction side feed channel and opening into the fourth row of exit slots.

4. The air cooled turbine rotor blade of claim 1, and further comprising:

the first and third rows of cooling channels are parallel to a chordwise plane of the blade; and, the second row of cooling channels are angled upward toward a blade tip.

5. The air cooled turbine rotor blade of claim 1, and further comprising:

the first and second and third rows of cooling channels include a metering inlet section followed by a first diffusion section that opens into an exit slot that forms a second diffusion section.

6. The air cooled turbine rotor blade of claim 1, and further comprising:

the first and second and third rows of exit slots each have a spanwise length of 0.33 inches and a width of 0.04 inches.

7. The air cooled turbine rotor blade of claim 1, and further comprising:

a fourth rows of exit slots opening on a surface of the suction side wall downstream from the leading edge region;

a row of metering holes connected to the suction side feed channel and opening into a first diffusion chamber upstream and in line with a rib;

the rib separating an upper channel and a lower channel;

both the upper channel and the lower channel having a second metering section followed by a second diffusion section; and, each second diffusion section opening into an exit slot on the pressure side wall of the blade in the trailing edge region.

8. The air cooled turbine rotor blade of claim 1, and further comprising:

a trailing edge region cooling circuit a row of impingement channels connected to a row of return channels between a row of impingement chambers located at a corner of the trailing edge of the blade;

a row of metering and diffusion film cooling slots connected to the return channels; and, where the cooling air flows from a supply channel in an aft direction to the impingement channels to impingement against the corner of the trailing edge, and then flows through the return channels in a forward direction and then through the metering and diffusion film cooling slots in an aft direction.

9. The air cooled turbine rotor blade of claim 8, and further comprising:

the impingement channels are located against the suction side wall;

the metering and diffusion film cooling slots are located along the pressure side wall; and, the return channels are located between the impingement channels and the metering and diffusion film cooling slots.

10. The air cooled turbine rotor blade of claim 1, and further comprising:

a multiple pass aft flowing serpentine flow cooling circuit located between the leading edge region and the trailing edge region of the blade;

a row of metering and diffusion film cooling slots opening onto the pressure side wall and the suction side wall of the blade and connected to the multiple pass serpentine flow cooling circuit;

each row of metering and diffusion film cooling slots includes a first metering section that opens into a first diffusion section, the first diffusion section opens into an upper channel and a lower channel separated by a rib, where each of the upper and lower channels includes a second metering section flowed by a second diffusion section, and where each of the second diffusion sections opens into an exit slot.

11. An air cooled turbine rotor blade comprising:

a leading edge region;

a pressure side cooling air feed channel;

a suction side cooling air feed channel;

a rib separating the pressure side cooling air feed channel from the suction side cooling air feed channel;

a pressure side exit slot opening onto the leading edge region of the blade;

a plurality of pressure side cooling air channels connected between the pressure side cooling air feed channel and the pressure side exit slot and formed within a pressure side wall in the leading edge region of the blade;

a suction side exit slot opening onto the leading edge region of the blade;

a plurality of suction side cooling air channels connected between the suction side cooling air feed channel and the suction side exit slot and formed within a suction side wall in the leading edge region of the blade;

a stagnation line exit slot onto the leading edge region of the blade; and, a plurality of stagnation line cooling air channels connected between the pressure side cooling air feed channel and the stagnation line exit slot and formed within the rib.

12. The air cooled turbine rotor blade of claim 10, and further comprising:

each of the pressure side and suction side and stagnation line cooling air channels includes a metering section that opens into a first diffusion section, and where the first diffusion section opens into the exit slot to form a second diffusion section.

13. The air cooled turbine rotor blade of claim 12, and further comprising:

the pressure side cooling air channels and the suction side cooling air channels are each parallel to a chordwise plane of the blade; and, the stagnation line cooling air channels are angled upward toward a blade tip of the blade at about 45 degrees.

14. The air cooled turbine rotor blade of claim 10, and further comprising:

the exit slots each have a spanwise height of about 0.33 inches and a width of about 0.04 inches.

15. The air cooled turbine rotor blade of claim 10, and further comprising:

each of the cooling air channels includes a first diffusion section that opens into an exit slot that forms a second diffusion section, and where the first diffusion section impinges the cooling air onto a wall of the exit slot.

16. The air cooled turbine rotor blade of claim 10, and further comprising:

the pressure side cooling air feed channel is separated from the suction side cooling air feed channels such that different pressures can be used.

* * * * *